US007850478B2

(12) United States Patent
Lin et al.

(10) Patent No.: US 7,850,478 B2
(45) Date of Patent: Dec. 14, 2010

(54) POWER SUPPLY AND RETENTION BAR FOR A POWER SUPPLY

(75) Inventors: Tien-Wen Lin, Tamshui Chen (TW); Yu-Ping Tsai, Tamshui Chen (TW); Kuo-Chu Yeh, Tamshui Chen (TW)

(73) Assignee: Acbel Polytech Inc., Taipei Hsien (TW)

( * ) Notice: Subject to any disclaimer, the term of this patent is extended or adjusted under 35 U.S.C. 154(b) by 0 days.

(21) Appl. No.: 12/458,521

(22) Filed: Jul. 15, 2009

(65) Prior Publication Data

US 2010/0105232 A1 Apr. 29, 2010

(30) Foreign Application Priority Data

Oct. 28, 2008 (TW) ..... 97219207 U

(51) Int. Cl.
*H01R 13/62* (2006.01)

(52) U.S. Cl. ..... 439/373; 439/372

(58) Field of Classification Search ..... 439/299, 439/373, 372, 371
See application file for complete search history.

(56) References Cited

U.S. PATENT DOCUMENTS

| | | | | |
|---|---|---|---|---|
| 4,204,738 | A * | 5/1980 | Tillotson | 439/369 |
| 5,593,313 | A * | 1/1997 | Shibuya et al. | 439/373 |
| 5,860,827 | A * | 1/1999 | Lee | 439/373 |
| 6,071,142 | A * | 6/2000 | Blackman | 439/373 |
| 6,176,728 | B1 * | 1/2001 | Bonnet et al. | 439/362 |
| 6,739,896 | B2 * | 5/2004 | Sivertsen | 439/371 |
| 6,767,237 | B1 * | 7/2004 | Shih | 439/371 |
| 7,134,902 | B1 * | 11/2006 | Lewis et al. | 439/373 |
| 7,140,903 | B2 * | 11/2006 | Pulizzi et al. | 439/371 |
| 7,207,826 | B1 * | 4/2007 | Yang | 439/373 |
| 7,241,163 | B1 * | 7/2007 | Cox et al. | 439/445 |
| 7,429,701 | B1 * | 9/2008 | Kushnir et al. | 174/53 |
| 7,513,791 | B1 * | 4/2009 | Gary | 439/373 |
| 7,695,305 | B1 * | 4/2010 | Ray et al. | 439/359 |
| 7,722,380 | B1 * | 5/2010 | West et al. | 439/373 |
| 2002/0068477 | A1 * | 6/2002 | Chen-Chiang et al. | 439/373 |
| 2008/0076291 | A1 * | 3/2008 | Ewing et al. | 439/373 |

* cited by examiner

*Primary Examiner*—Ross N Gushi
(74) *Attorney, Agent, or Firm*—Bacon & Thomas, PLLC

(57) ABSTRACT

A power supply has an outer shell and a retention bar. The outer shell has a rear panel and a cover. The rear panel has a socket and two guide slots. The cover has two pivot slots and two pivot mounts. Each pivot slot is formed through the cover adjacent to a corresponding guide slot. The pivot mounts are formed from and protrudes inwardly from the cover and have pivot holes formed therethrough. The retention bar is mounted in the pivot holes of the pivot mounts and has a clip and two protrusions. Therefore, when the power supply is mounted in a casing of a machine, the retention bar simultaneously fastens the power supply to the casing and a plug to the power supply.

10 Claims, 6 Drawing Sheets

POWER SUPPLY AND RETENTION BAR FOR A POWER SUPPLY

BACKGROUND

1. Field of the Invention

The present invention relates to a power supply, especially to a power supply that self-fastens to a machine shell and securely holds a power cable.

2. Description of the Prior Arts

With reference to FIG. 5, a power supply in accordance with the prior art has an outer shell (90) and a retention bar (91). The outer shell (90) has a side panel (92), a socket (93) and two pivot mounts (94). The socket (93) is mounted in the side panel (92) of the outer shell (90). The pivot mounts (94) are formed on the side panel (92) of the outer shell (90) adjacent to the socket (93) and each has a pivot hole formed therethrough. The retention bar (91) has a central segment, two pivotal ends (95) and a clip (96). The pivotal ends (95) are respectively mounted in the pivot holes of the pivot mounts (94). The clip (96) is formed in the central segment of the retention bar and corresponds to a plug to hold the plug in the power supply.

With further reference to FIG. 6, another power supply in accordance with the prior art has a handle (81) and two protrusions (82). When the handle (81) is pressed to move the protrusions (82) backward, the power supply can be installed on a machine shell of a machine. When the fastener of the power supply is released, the protrusions (82) recover to original protrusions to securely hold the power supply on the machine shell of the machine.

However, the power supply is mounted securely on a machine shell of a machine and is easily disconnected and falls out from machine shell when people carelessly collide with the power supply.

To overcome the shortcomings, the present invention provides a to mitigate or obviate the aforementioned problems.

SUMMARY OF THE INVENTION

The main objective of the present invention is to provide a power supply that self-fastens to a machine shell and securely holds a power cable.

A power supply in accordance with the present invention has an outer shell and a retention bar. The outer shell has a rear panel and a cover. The rear panel has a socket and two guide slots. The cover has two pivot slots and two pivot mounts. Each pivot slot is respectively formed through the cover adjacent to a corresponding guide slot. The pivot mounts are formed from and protrude inwardly from the cover and have pivot holes respectively formed therethrough. The retention bar is mounted in the pivot holes of the pivot mounts and has a clip and two protrusions. Therefore, when the power supply is mounted in a casing of a machine, the retention bar simultaneously fastens the power supply to the casing and a plug to the power supply.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
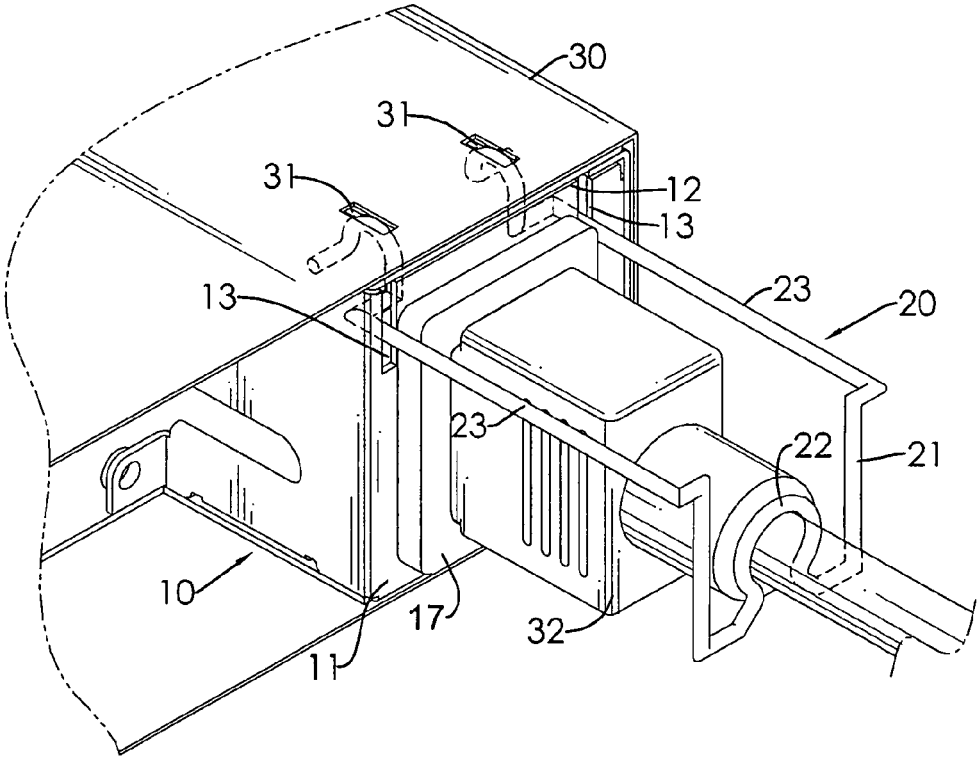
FIG. 1 is a perspective view of a power supply in accordance with the present invention.
Figure 2:
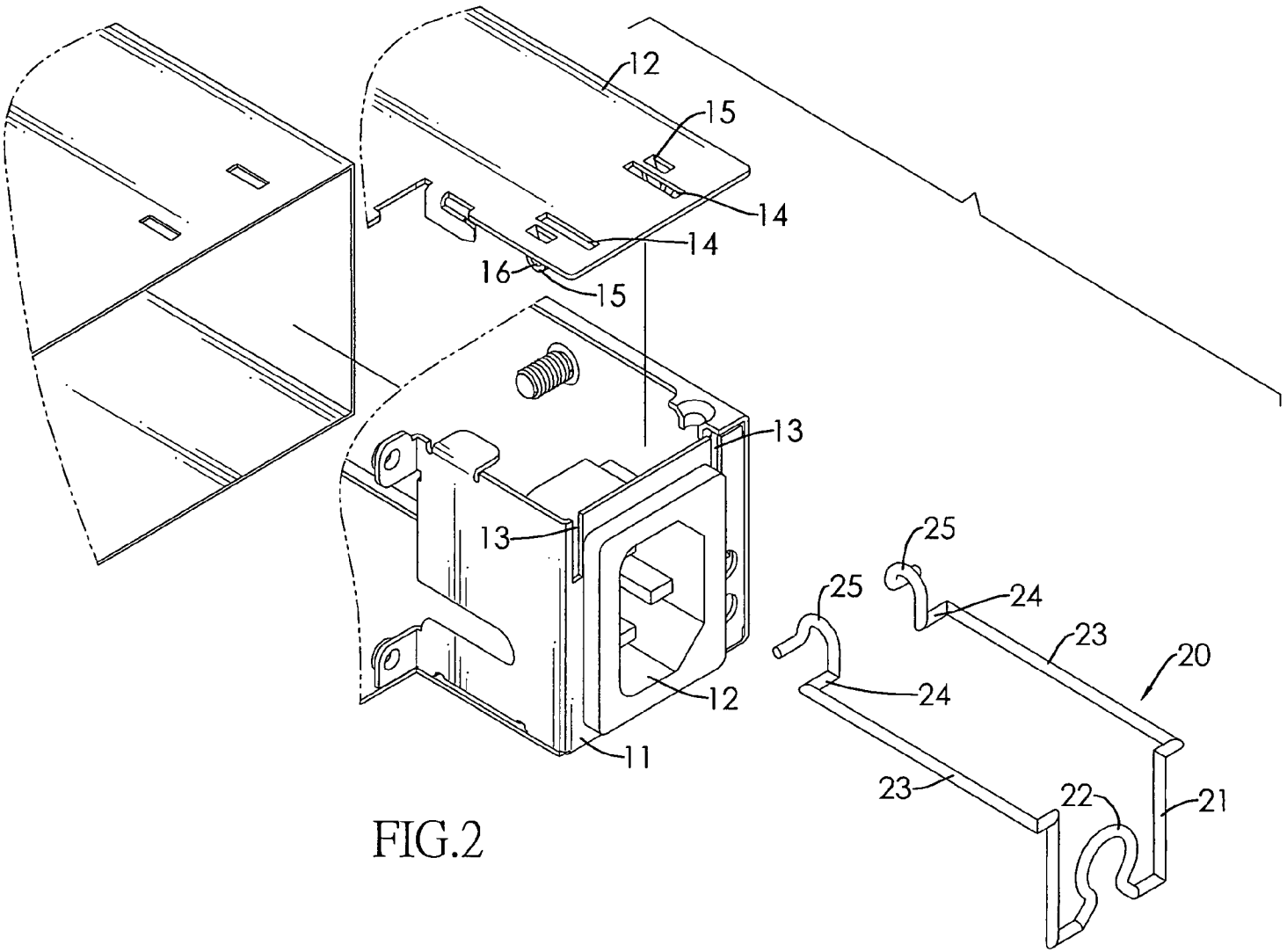
FIG. 2 is an exploded perspective view of the power supply in FIG. 1.

With reference to FIGS. 1 and 2, a power supply in accordance with the present invention comprises an outer shell (10) and a retention bar (20).

The outer shell (10) has a rear panel (11) and a cover (12). The rear panel (10) has a socket (17) and two guide slots (13). The socket (17) is mounted through the rear panel (10) and has two sides. The guide slots (13) are formed through the rear panel (10) of the outer shell (10) adjacent respectively to the sides of the socket (17). The cover (12) is mounted on the rear panel (11) and has two pivot slots (14) and two pivot mounts (15). The pivot slots (14) are formed in the cover (11) parallel with and adjacent respectively to the guide slots (13) of the rear panel (11) and each pivot slot (14) has an outer edge. The pivot mounts (15) are formed from and protrude inwardly from the cover (12), may be adjacent respectively to the outer edges of the pivot slots (14), and each pivot mount (15) has a pivot hole (16) formed therethrough.

The retention bar (20) may be metal and is mounted in the pivot holes (16) of the pivot mounts (15) and has two arms (23) and a clip (22). The arms (23) are parallelly disposed, may be parallelly mounted respectively through the guide slots (13) and each arm (23) has a distal end, a proximal end, a transverse bar (24) and an arch (25). The transverse bar (24) is formed on and protrudes inwards from the proximal end. The arch (25) is formed on the transverse bar (24), aligns with and protrudes through one of the pivot slots (14), is mounted pivotally on one pivot mount (15) and has an inner leg and an outer leg. The inner leg of the arch (25) is mounted pivotally in the pivot hole (16) of one pivot mount (15). The outer leg of the arch (25) is formed on the transverse bar (24) and is longer than the inner leg of the arch (25). The clip (22) is formed perpendicularly on the distal ends of the arms (23) and has two spacer bars (21) and a clasp being a reflex arc or the like. The spacer bars (21) are respectively formed on and protrude perpendicularly from the distal ends of the arms (23) and each spacer bar (21) has a clasp end. The clasp is formed on and joins the clasp ends of the spacer bars (21).

Figure 3:
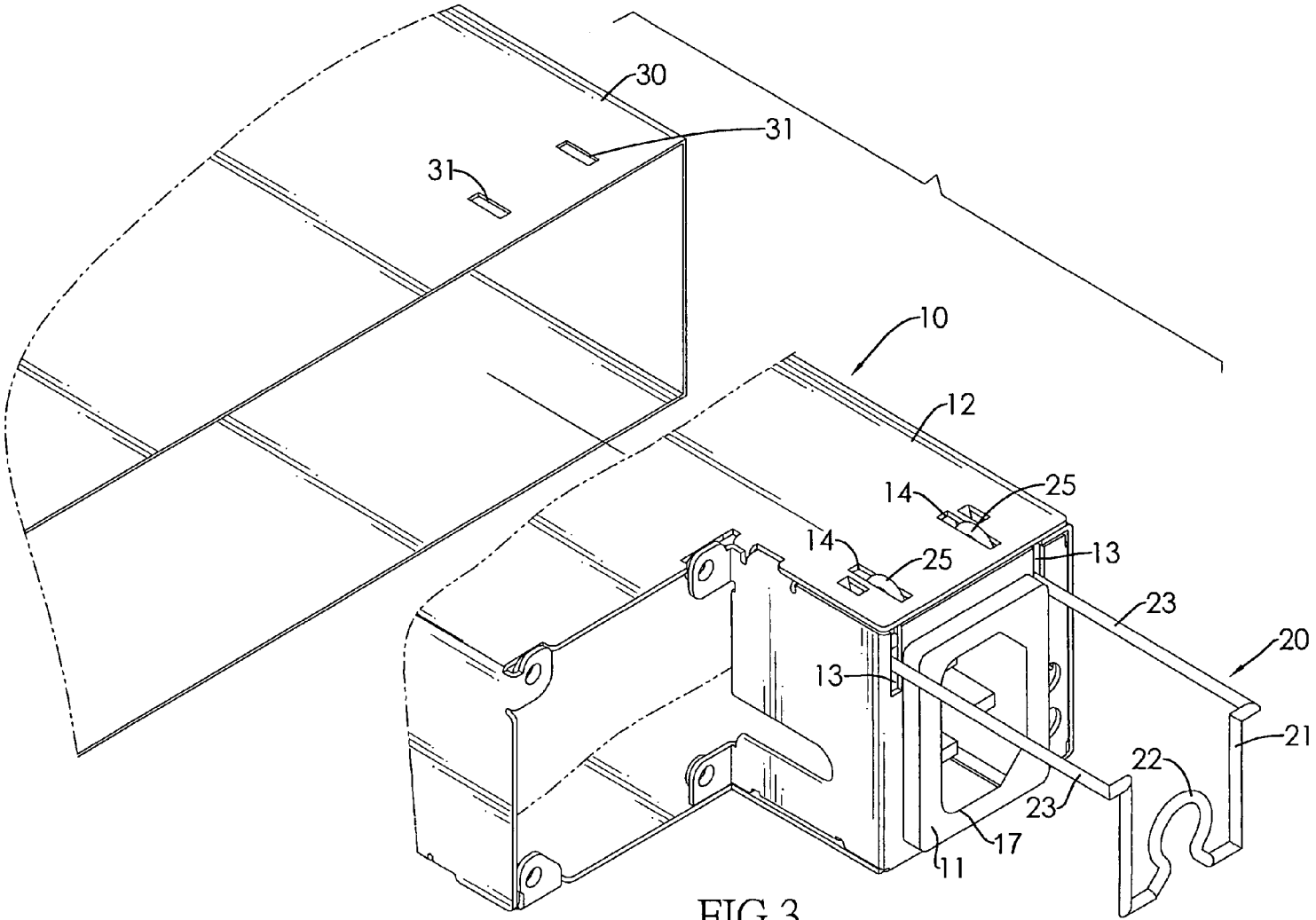
FIG. 3 is a perspective view of the power supply in FIG. 1, shown being mounted in a casing of a machine.
Figure 4:
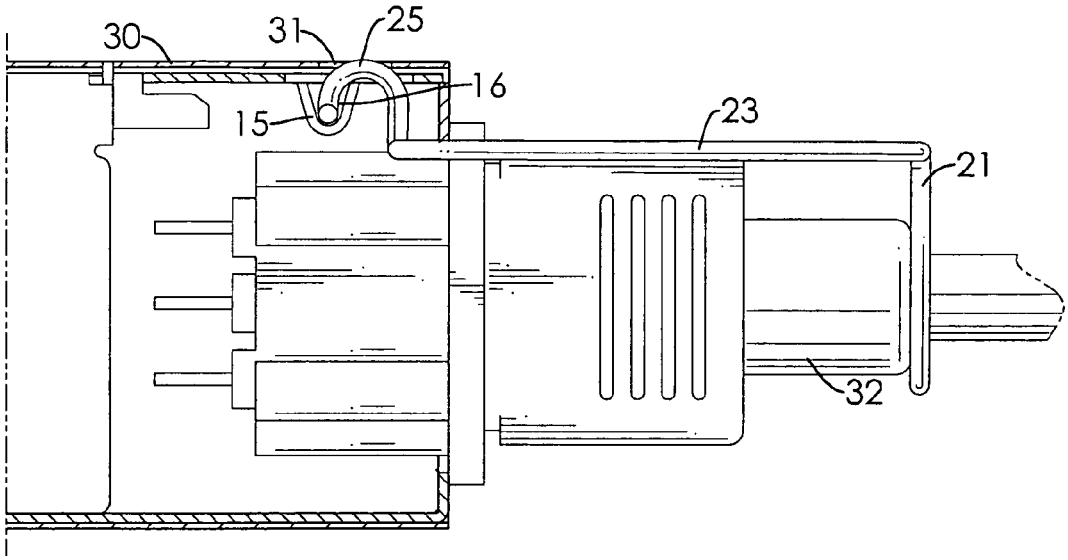
FIG. 4 is a side view in partial section of the power supply in FIG. 1, showing that the power supply mounted in the casing.
Figure 5:
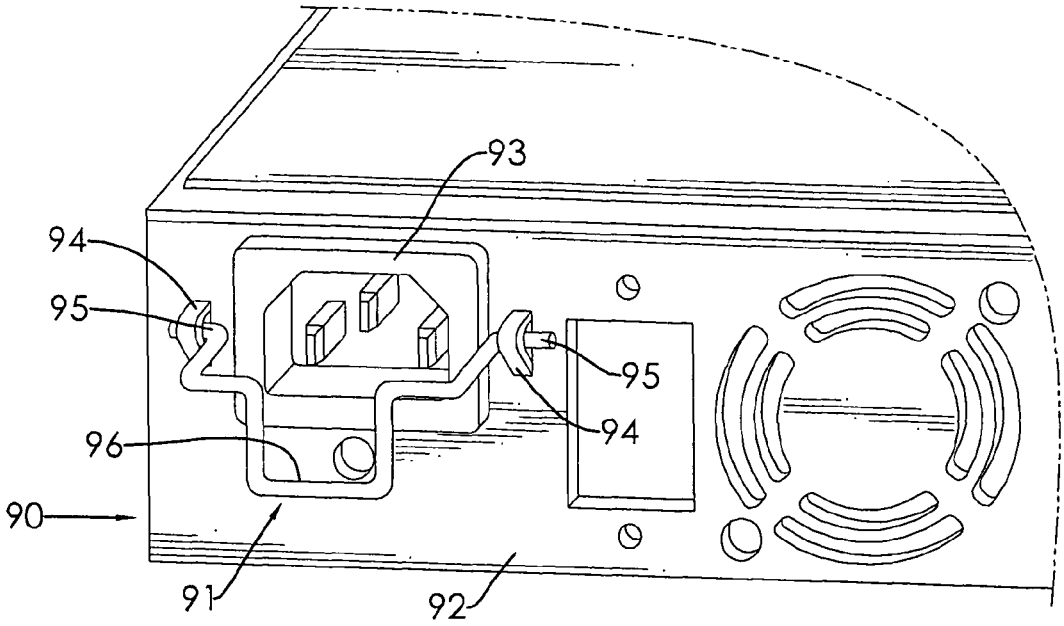
FIG.5 PRIOR ART
FIG. 5 is a perspective view of a power supply in accordance with the prior art.
Figure 6:
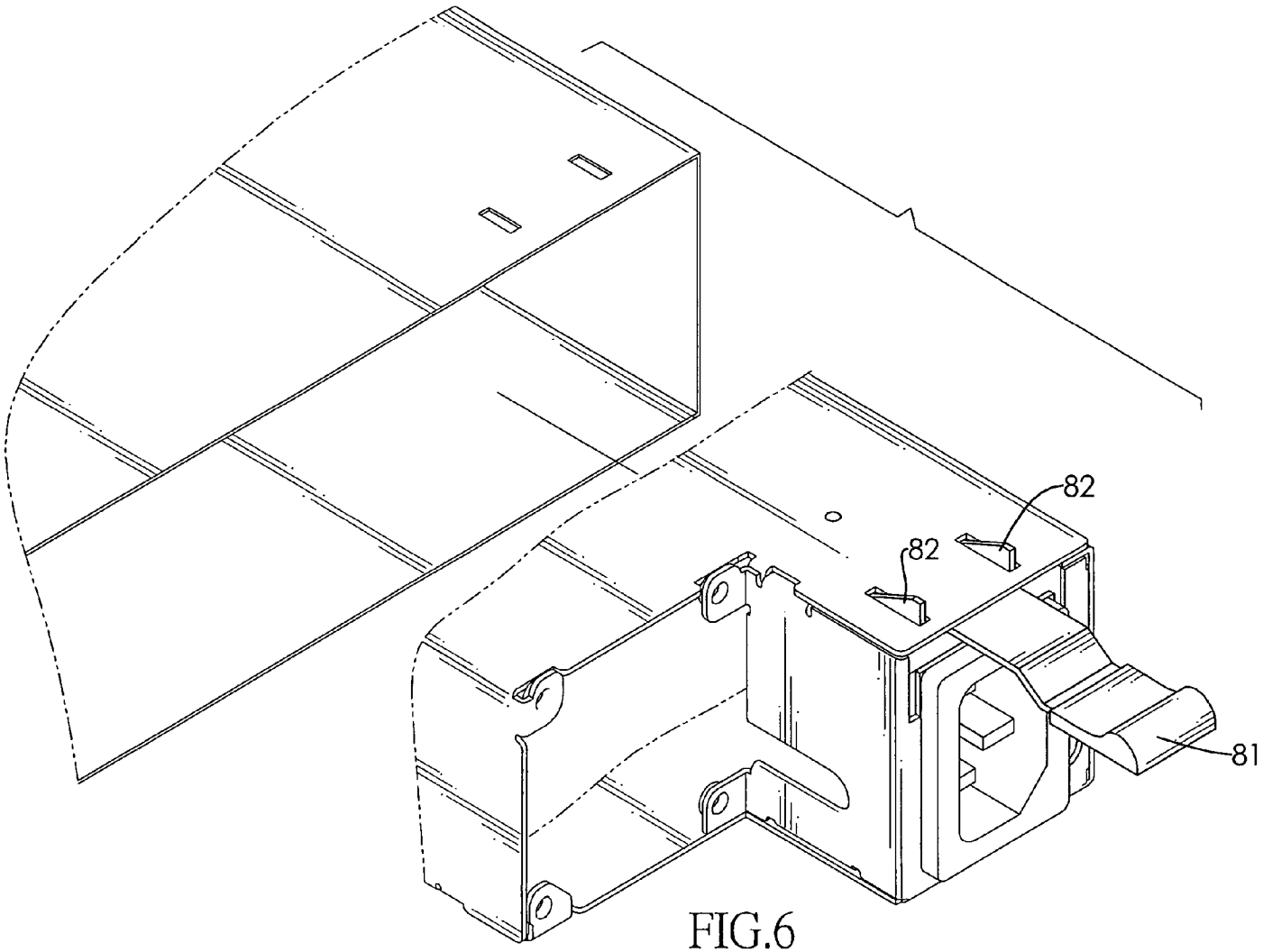
FIG.6 PRIOR ART
FIG. 6 is a perspective view of another power supply in accordance with the prior art.

With reference to FIGS. 1, 3 and 4, the power supply is mounted in a casing (30) of a machine. The casing (30) has two detent slots (31) corresponding respectively to and shorter than the pivot slots (14) of the cover (12). A plug (32) is inserted in the socket (17) of the power supply, and the retention bar (20) can be pivoted to clasp the plug (32). Then, the power supply is slid into the casing (30) so the arches (25) are mounted respectively in the detent slots (31) of the casing (30) to securely hold the power supply in the casing (30) and the clip (22) on the plug.

Even though numerous characteristics and advantages of the present invention have been set forth in the foregoing description, together with details of the structure and features of the invention, the disclosure is illustrative only.

Changes may be made in the details, especially in matters of shape, size, and arrangement of parts within the principles of the invention to the full extent indicated by the broad general meaning of the terms in which the appended claims are expressed.

What is claimed is:

1. A power supply comprising an outer shell having a rear panel having a socket mounted through the rear panel and having two sides; and two guide slots formed through the rear panel of the outer shell adjacent respectively to the sides of the socket; and a cover mounted on the rear panel and having two pivot slots formed in the cover parallel with and respectively adjacent to the guide slots of the rear panel and each pivot slot having an outer edge; and two pivot mounts formed from and protruding inwardly from the cover and each having a pivot hole formed therethrough; and a retention bar mounted in the pivot holes of the pivot mounts and having two arms parallelly mounted respectively through the guide slots and each arm having a distal end;

a proximal end;

a transverse bar formed on and protruding inwards from the proximal end;

an arch formed on the transverse bar, aligning with and protruding through one of the pivot slots, mounted pivotally on one pivot mount and having an inner leg mounted pivotally in the pivot hole of one pivot mount; and an outer leg formed on the transverse bar and being longer than the inner leg; and a clip formed perpendicularly on the distal ends of the arms and having two spacer bars respectively formed on and protruding from the distal ends of the arms and each spacer bar having a clasp end; and a clasp formed on and joining the clasp ends of the spacer bars.

2. The power supply as claimed in claim 1, wherein the clasp is a reflex arc.

3. The power supply as claimed in claim 1, wherein the retention bar is metal.

4. The power supply as claimed in claim 1, wherein the proximal ends of the arms extend perpendicularly and respectively from the arms.

5. The power supply as claimed in claim 4, wherein the clasp is a reflex arc.

6. A retention bar for a power supply having two arms parallelly disposed and each arm having a distal end; and a proximal end;

a transverse bar formed on and protruding inwards from the proximal end;

an arch formed on the transverse bar and having an inner leg; and an outer leg formed on the transverse bar and being longer than the inner leg; and a clip formed perpendicularly on the distal ends of the arms and having two spacer bars respectively formed on and protruding from the distal ends of the arms and each spacer bar having a clasp end; and a clasp formed on and joining the clasp ends of the spacer bars.

7. The retention bar as claimed in claim 6, wherein the clasp is a reflex arc.

8. The retention bar as claimed in claim 6, wherein the retention bar is metal.

9. The retention bar as claimed in claim 6, wherein the proximal ends of the arms extend perpendicularly and respectively from the arms.

10. The retention bar as claimed in claim 9, wherein the clasp is a reflex arc.

* * * * *